US009825408B2

(12) United States Patent
Henry et al.

(10) Patent No.: US 9,825,408 B2
(45) Date of Patent: Nov. 21, 2017

(54) CONNECTOR MODULE ASSEMBLY HAVING A GASKET PLATE

(71) Applicant: TYCO ELECTRONICS CORPORATION, Berwyn, PA (US)

(72) Inventors: Randall Robert Henry, Harrisburg, PA (US); Michael John Phillips, Camp Hill, PA (US); Brandon Michael Matthews, McAlisterville, PA (US); Nikhil Shankar, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/069,170

(22) Filed: Mar. 14, 2016

(65) Prior Publication Data

US 2017/0264052 A1 Sep. 14, 2017

(51) Int. Cl.

| | |
|---|---|
| ***H01R 13/648*** | (2006.01) |
| ***H01R 13/60*** | (2006.01) |
| ***H01R 13/659*** | (2011.01) |
| ***H01R 13/518*** | (2006.01) |

(52) U.S. Cl.

CPC ..... *H01R 13/659* (2013.01); *H01R 13/518* (2013.01)

(58) Field of Classification Search

CPC ..... H01R 13/6586; H01R 13/6594; H01R 13/659; H01R 13/6581

USPC ..... 439/607.21, 607.23–607.25, 607.04, 439/540.1, 541.5

See application file for complete search history.

(56) References Cited

U.S. PATENT DOCUMENTS

| | | | | |
|---|---|---|---|---|
| 5,961,350 | A | 10/1999 | Shiu | |
| 6,893,293 | B2 | 5/2005 | Ice et al. | |
| 8,393,917 | B2 * | 3/2013 | Regnier | H05K 7/20709 439/485 |
| 8,449,331 | B2 | 5/2013 | Phillips et al. | |
| 8,864,523 | B2 | 10/2014 | Banakis et al. | |
| 8,888,538 | B2 * | 11/2014 | Regnier | H01R 12/724 439/540.1 |
| 9,035,199 | B2 * | 5/2015 | Janota | H05K 9/0007 174/355 |
| 9,142,922 | B2 * | 9/2015 | Regnier | H01R 13/65802 |
| 9,391,407 | B1 * | 7/2016 | Bucher | H01R 13/659 |
| 9,666,995 | B1 * | 5/2017 | Phillips | H01R 13/6581 |

(Continued)

*Primary Examiner* — Abdullah Riyami
*Assistant Examiner* — Thang Nguyen

(57) ABSTRACT

A receptacle assembly includes communication connectors secured together as a communication module each having a contact array arranged within a shroud for mating with a pluggable module. A gasket plate is coupled to the communication module between the communication module and the pluggable modules. The gasket plate has a plurality of openings receiving corresponding shrouds and pluggable module interfaces around each of the openings for interfacing with mating ends of the pluggable modules. The receptacle assembly includes a receptacle housing having a plurality of panels dividing a housing cavity into module cavities. The gasket plate is coupled to the communication module to define a connector module assembly. The connector module assembly is loaded into the housing cavity prior to mounting to the circuit board such that the connector module assembly and the receptacle housing are configured to be mounted to the circuit board as a unit.

20 Claims, 10 Drawing Sheets

(56) References Cited

U.S. PATENT DOCUMENTS

| | | | | |
|---|---|---|---|---|
| 9,666,997 | B1 * | 5/2017 | Henry | H01R 13/659 |
| 2003/0171033 | A1 * | 9/2003 | Bright | G02B 6/4201 439/607.25 |
| 2006/0003632 | A1 * | 1/2006 | Long | H01R 12/716 439/607.2 |
| 2008/0171469 | A1 * | 7/2008 | Phillips | H01R 13/6582 439/607.01 |
| 2009/0098767 | A1 * | 4/2009 | Long | G02B 6/0001 439/541.5 |
| 2015/0171560 | A1 * | 6/2015 | Yu | H01R 13/6593 439/607.25 |
| 2015/0249308 | A1 * | 9/2015 | Recce | H01R 13/641 439/490 |
| 2015/0372428 | A1 * | 12/2015 | Long | H01R 13/6582 439/607.04 |

* cited by examiner

CONNECTOR MODULE ASSEMBLY HAVING A GASKET PLATE

BACKGROUND OF THE INVENTION

The subject matter described herein relates to communication systems.

At least some known communication systems include receptacle assemblies, such as input/output (I/O) connector assemblies, that are configured to receive a pluggable module and establish a communicative connection between the pluggable module and an electrical connector of the receptacle assembly. As one example, a known receptacle assembly includes a receptacle housing that is mounted to a circuit board and configured to receive a small form-factor (SFP) pluggable transceiver. The receptacle assembly includes an elongated cavity that extends between an opening of the cavity and an electrical connector that is disposed within the cavity and mounted to the circuit board. The pluggable module is inserted through the opening and advanced toward the electrical connector in the cavity. The pluggable module and the electrical connector have respective electrical contacts that engage one another to establish a communicative connection. Conventional communication systems may include multiple cavities and communication connectors for mating with multiple pluggable modules.

Challenges often encountered in the design of the communication system involve dissipating heat generated during operation of the communication system and minimizing electromagnetic interference (EMI), as both heat and EMI negatively affect module/system reliability and electrical performance. Heat dissipation is enhanced by increasing airflow through the components, such as by including openings to allow airflow. In contrast, EMI is reduced by adding shielding in the form of conductive panels that cover or shield the components. Providing openings in the conductive panels to enhance heat dissipation negatively affects shielding effectiveness. A balance between the competing design interests must be met, while maintaining a small form factor. One solution to enhancing heat dissipation is to enlarge the opening or port to the cavity that holds the pluggable module to increase airflow over the pluggable module. However, to provide a larger port, EMI shielding components, typically arranged at the port, are relocated within the receptacle housing to a location at the mating end of the pluggable module. Providing effective shielding at the mating interfaces has been problematic.

Accordingly, there is a need for a communication system design that provides reliable EMI shielding at the mating interface between pluggable modules and the corresponding communication connectors within the receptacle housing.

BRIEF DESCRIPTION OF THE INVENTION

In an embodiment, a receptacle assembly is provided including a plurality of communication connectors arranged side-by-side and secured together as a communication module. Each communication connector having a contact array arranged within a shroud at a mating interface. The shroud and contact array being configured for mating with a corresponding pluggable module. Each communication connector having a mounting face at a bottom of the corresponding communication connector and the contact array is provided at the mounting face for mounting to a circuit board. A gasket plate is coupled to the communication module between the communication module and the pluggable modules. The gasket plate has a plurality of openings receiving corresponding shrouds such that the shrouds pass through the openings for mating with the corresponding pluggable modules. The gasket plate has pluggable module interfaces around each of the openings for interfacing with mating ends of the pluggable modules associated with the corresponding openings. The gasket plate is conductive to provide electromagnetic interference (EMI) shielding at the pluggable module interfaces. The receptacle assembly includes a receptacle housing having a plurality of panels defining a housing cavity. The plurality of panels divide the housing cavity into a plurality of module cavities each configured to receive a corresponding pluggable module therein. The panels are conductive to provide electromagnetic interference (EMI) shielding for the housing cavity. The receptacle housing is configured to be mounted to the circuit board at a bottom of the receptacle housing. The gasket plate is coupled to the communication module to define a connector module assembly. The connector module assembly is loaded into the housing cavity prior to mounting to the circuit board such that the connector module assembly and the receptacle housing are configured to be mounted to the circuit board as a unit.

In another embodiment, a receptacle assembly is provided including a receptacle housing having a plurality of panels defining a housing cavity. The receptacle housing has a bottom for mounting to a circuit board. The plurality of panels include front separator panels dividing the housing cavity into a plurality of module cavities each configured to receive a corresponding pluggable module therein. The module cavities are arranged in a plurality of rows and a plurality of columns. The panels are conductive to provide electromagnetic interference (EMI) shielding for the housing cavity. The receptacle assembly includes a connector module assembly received in the housing cavity. The connector module assembly includes a plurality of communication connectors arranged side-by-side as a communication module. Each communication connector has a contact array arranged within a shroud at a mating interface. The shroud and contact array are aligned with a corresponding module cavity and configured for mating with a corresponding pluggable module. The contact array is configured to be mounted to a circuit board. The connector module assembly includes a plurality of rear separator panels arranged between adjacent communication connectors. The communication connectors are secured to the corresponding adjacent rear separator panels to secure the communication connectors together as the communication module. The connector module assembly includes a gasket plate coupled to the communication module and positioned between the front separator panels and the rear separator panels. The gasket plate spans across and between each of the module cavities. The gasket plate spans across and between each of the communication modules. The gasket plate has a plurality of openings aligned with corresponding module cavities and receiving corresponding shrouds such that the shrouds pass through the openings into the corresponding module cavities for mating with the pluggable modules. The gasket plate has pluggable module interfaces around each of the openings for interfacing with mating ends of the pluggable modules associated with the corresponding openings. The gasket plate is conductive to provide EMI shielding at the pluggable module interfaces.

In a further embodiment, a connector module assembly is provided including a plurality of communication connectors arranged side-by-side as a communication module. Each communication connector has a housing holding a contact array. The housing includes a shroud including a receiving slot with the contact array disposed in the receiving slot for mating with a corresponding pluggable module. The housing has a first side with a first lug and a second side with a second lug. A plurality of rear separator panels are arranged between adjacent communication connectors. The rear separator panels engage corresponding first and second lugs of the adjacent communication connectors to secure the communication connectors together as the communication module. A gasket plate is coupled to the communication module. The gasket plate has a plurality of openings receiving corresponding shrouds such that the shrouds pass through the openings for mating with the pluggable modules. The gasket plate has pluggable module interfaces around each of the openings for interfacing with mating ends of the pluggable modules associated with the corresponding openings. The gasket plate is conductive to provide EMI shielding at the pluggable module interfaces.

DETAILED DESCRIPTION OF THE INVENTION

Embodiments set forth herein include communication systems providing electromagnetic interference (EMI) shielding and significant thermal transfer for the components thereof. Various embodiments of the communication system provide EMI shielding at the interface between pluggable modules and corresponding communication connectors. Various embodiments of the communication system provide a receptacle housing or cage that allows significant airflow therethrough while maintaining EMI shielding in a robust and compact design. Various embodiments of the communication system include multiple communication connectors stacked and ganged together in a dense package while providing EMI shielding for the interfaces between the communication connectors and the pluggable modules.

Unlike conventional systems that utilize gaskets or other shielding features at the entrance to the ports, embodiments set forth herein provide EMI shielding at the mating interface between the pluggable modules and the communication connectors allowing the ports to be open defining air channels at the ports. In various embodiments, the EMI shields are movable within the receptacle housing for mating with the pluggable modules and to provide mating tolerance. In various embodiments, the communication connectors and the shielding cage are pre-assembled and then mounted to a circuit board as a unit.

Figure 1:
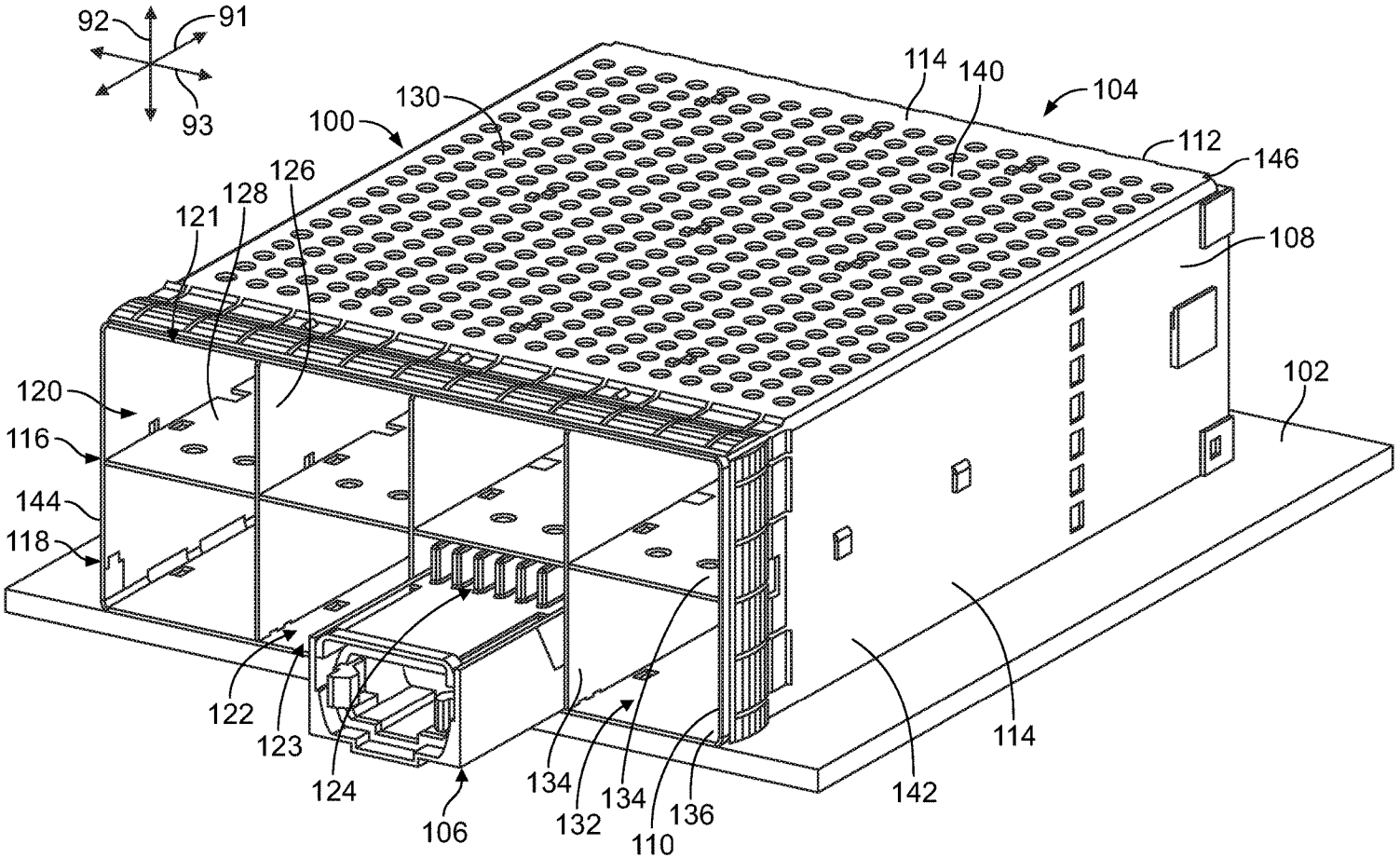
FIG. 1 is a perspective view of a communication system having a receptacle assembly in accordance with an embodiment.

FIG. 1 is a perspective view of a communication system 100 in accordance with an embodiment. The communication system 100 may include a circuit board 102, a receptacle assembly 104 mounted to the circuit board 102, and one or more pluggable modules 106 that are configured to communicatively engage the receptacle assembly 104. The communication system 100 is oriented with respect to a mating or insertion axis 91, an elevation axis 92, and a lateral axis 93. The axes 91-93 are mutually perpendicular. Although the elevation axis 92 appears to extend in a vertical direction parallel to gravity in FIG. 1, it is understood that the axes 91-93 are not required to have any particular orientation with respect to gravity. Moreover, only one pluggable module 106 is shown in FIG. 1, but it is understood that multiple pluggable modules 106 may simultaneously engage the receptacle assembly 104.

The communication system 100 may be part of or used with telecommunication systems or devices. For example, the communication system 100 may be part of or include a switch, router, server, hub, network interface card, or storage system. In the illustrated embodiment, the pluggable module 106 is configured to transmit data signals in the form of electrical signals. In other embodiments, the pluggable module 106 may be configured to transmit data signals in the form of optical signals. The circuit board 102 may be a daughter card or a mother board and include conductive traces (not shown) extending therethrough.

The receptacle assembly 104 includes a receptacle housing 108 that is mounted to the circuit board 102. The receptacle housing 108 may also be referred to as a receptacle cage. The receptacle housing 108 may be arranged at a bezel or faceplate (not shown) of a chassis of the system or device, such as through an opening in the faceplate. As such, the receptacle housing 108 is interior of the device and corresponding faceplate and the pluggable module(s) 106 is loaded into the receptacle housing 108 from outside or exterior of the device and corresponding faceplate.

The receptacle housing 108 includes a front end 110 and an opposite back end 112. The front end 110 may be provided at, and extend through an opening in, the faceplate. The mating axis 91 may extend between the front and back ends 110, 112. Relative or spatial terms such as "front," "back," "top," or "bottom" are only used to distinguish the referenced elements and do not necessarily require particular positions or orientations in the communication system 100 or in the surrounding environment of the communication system 100. For example, the front end 110 may be located in or facing a back portion of a larger telecommunication system. In many applications, the front end 110 is viewable to a user when the user is inserting the pluggable module 106 into the receptacle assembly 104.

The receptacle housing 108 is configured to contain or block electromagnetic interference (EMI) and guide the pluggable module(s) 106 during a mating operation. To this end, the receptacle housing 108 includes a plurality of conductive housing walls 114 that are interconnected with one another to form the receptacle housing 108. The housing walls 114 may be formed from a conductive material, such as sheet metal and/or a polymer having conductive particles. In the illustrated embodiment, the housing walls 114 are stamped and formed from sheet metal. In some embodiments, the receptacle housing 108 is configured to facilitate airflow through the receptacle housing 108 to transfer heat (or thermal energy) away from the receptacle assembly 104 and pluggable module(s) 106. The air may flow from inside the receptacle housing 108 (for example, behind the faceplate) to the external environment (for example, forward of the faceplate) or from outside the receptacle housing 108 into the interior of the receptacle housing 108. Fans or other air moving devices may be used to increase airflow through the receptacle housing 108 and over the pluggable module(s) 106. The housing walls 114 may include openings to allow airflow therethrough. The openings may be sized small enough such that the housing walls 114 provide effective EMI shielding.

In the illustrated embodiment, the receptacle housing 108 includes a first (or upper) row 116 of elongated module cavities 120 and a second (or lower) row 118 of elongated module cavities 122. Each of the module cavities 120, 122 extends between the front and back ends 110, 112. The module cavities 120, 122 have respective openings or ports 121, 123 that are sized and shaped to receive corresponding pluggable modules 106. The module cavities 120, 122 may have the same or similar dimensions and extend lengthwise in a direction that is parallel to the mating axis 91. In the illustrated embodiment, each upper module cavity 120 is stacked over a corresponding lower module cavity 122 such that the lower module cavity 122 is positioned between the upper module cavity 120 and the circuit board 102. In an exemplary embodiment, the module cavities 120, 122 are arranged in a plurality of columns. Any number of module cavities may be provided including a single row and/or a single column of module cavities.

In an exemplary embodiment, the module cavities 120, 122 include airflow channels 124 at the front end 110 to allow airflow therethrough along the pluggable modules 106, such as along top surfaces of the pluggable modules 106, to enhance heat transfer of the pluggable modules 106 located in the module cavities 120, 122. The housing walls 114 of the receptacle housing 108 may include front separator panels 126 that extend vertically between adjacent columns of the module cavities 120, 122. The housing walls 114 may include separator plates 128 that extend horizontally between the upper module cavities 120 and the lower module cavities 122. For example, the separator plates 128 may extend between adjacent front separator panels 126 or between side walls 142, 144 and the front separator panels 126. The separator panels 126 and the separator plates 128 may extend generally parallel to the mating axis 91 at least partially between the front end 110 and the back end 112. The separator panels 126 and the separator plates 128 may define portions of the airflow channels 124.

The receptacle housing 108 is formed from a plurality of interconnected panels or sheets. For example, the receptacle housing 108 includes a main panel or shell 130 that surrounds a housing cavity 132. The receptacle housing 108 includes a plurality of interior panels 134 that define the separator panels 126 and the separator plates 128. The receptacle housing 108 may include a base panel 136. The base panel 136 may rest on the circuit board 102. The main panel 130, the interior panels 134, and the base panel 136 may be stamped and formed from sheet metal. The main panel 130, the interior panels 134, and the base panel 136 are assembled to form the module cavities 120, 122. In an exemplary embodiment, the main panel 130 includes a top wall 140, the side walls 142, 144, and a back wall 146 formed integral with each other; however any of such walls may be separate and coupled to the other walls. The interior panels 134 are configured to be positioned within the housing cavity 132. The interior panels 134 apportion or divide the housing cavity 132 into the separate module cavities 120, 122. The interior panels 134 may be coupled together and/or coupled to the main panel 130, such as using tabs or other connecting features.

The main panel 130, the interior panels 134, and the base panel 136 may comprise conductive material, such as metal. When the receptacle housing 108 is mounted to the circuit board 102, the receptacle housing 108 and the receptacle assembly 104 are electrically coupled to the circuit board 102 and, in particular, to ground planes (not shown) within the circuit board 102 to electrically ground the receptacle housing 108 and the receptacle assembly 104. As such, the receptacle assembly 104 may reduce EMI leakage that may negatively affect electrical performance of the communication system 100.

The pluggable module 106 is an input/output (I/O) module configured to be inserted into and removed from the receptacle assembly 104. The pluggable module 106 is configured to be inserted into the module cavity 122 of the receptacle housing 108 and advanced in a mating direction along the mating axis 91. In some embodiments, the pluggable module 106 is a small form-factor pluggable (SFP) transceiver or quad small form-factor pluggable (QSFP) transceiver. The pluggable module 106 may satisfy certain technical specifications for SFP or QSFP transceivers, such as Small-Form Factor (SFF)-8431. In some embodiments, the pluggable module 106 is configured to transmit data signals up to 2.5 gigabits per second (Gbps), up to 5.0 Gbps, up to 10.0 Gbps, or more. By way of example, the receptacle assembly 104 and the pluggable module 106 may be similar to the receptacle cages and transceivers, respectively, which are part of the SFP+ product family available from TE Connectivity.

The receptacle assembly 104 includes a connector module assembly 148 (shown in FIG. 3) at the back end 112. Optionally, the base panel 136 may form part of the connector module assembly 148. The pluggable module(s) 106 is mated with the connector module assembly 148. In an exemplary embodiment, EMI shielding is provided at the connector module assembly 148 to provide electrical shielding at the interface with the pluggable modules 106. For example, one or more gaskets may be provided at the mating interfaces. The EMI shielding is electrically connected to the conductive housing walls 114 to electrically common the EMI shielding of the connector module assembly 148 with the other portions of the receptacle housing 108.

Figure 2:
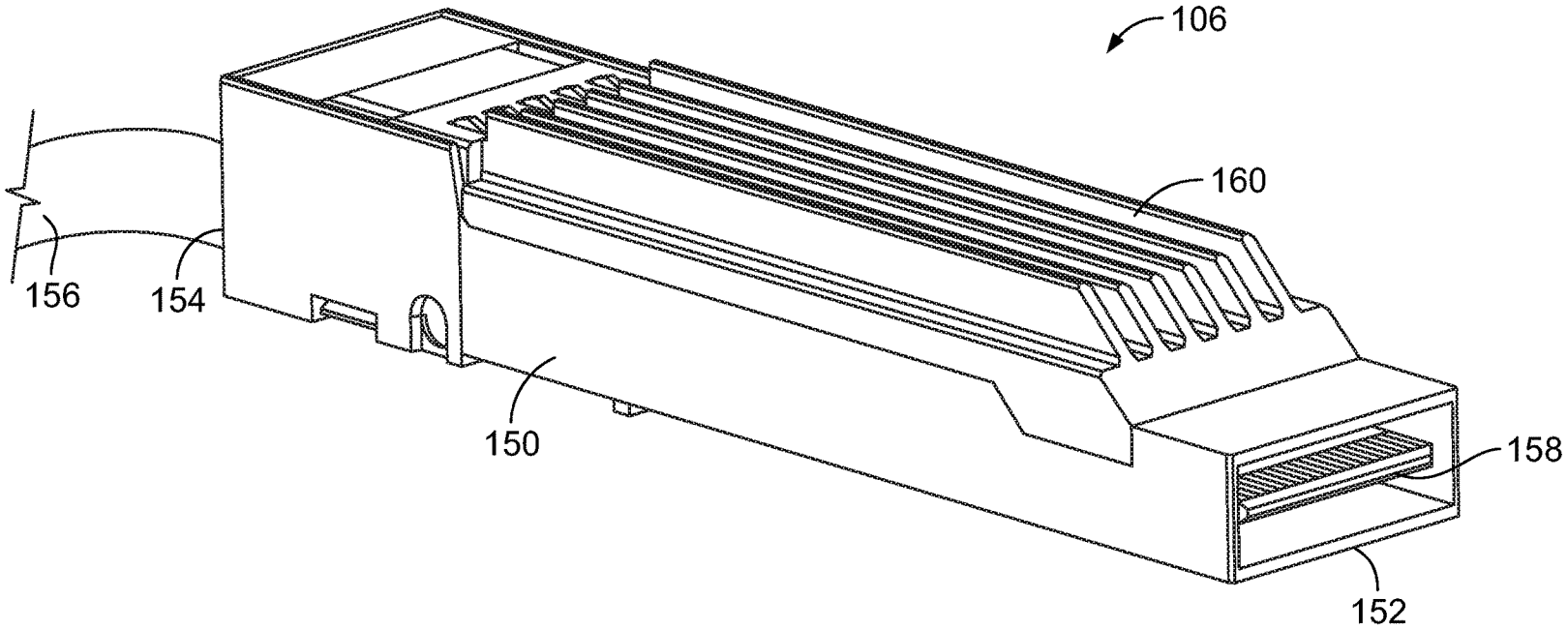
FIG. 2 is a perspective view of a pluggable module of the communication system in accordance with an exemplary embodiment.

FIG. 2 is a perspective view of the pluggable module 106 in accordance with an exemplary embodiment. In some embodiments, the pluggable module 106 is an input/output cable assembly having a pluggable body 150. The pluggable body 150 includes a mating end 152 and an opposite cable end 154. A cable 156 is coupled to the pluggable body 150 at the cable end 154. The pluggable body 150 also includes an internal circuit board 158 that is communicatively coupled to electrical wires or optical fibers (not shown) of the cable 156. The internal circuit board 158 may be exposed at the mating end 152 for mating with the connector module assembly 148 (shown in FIG. 3). The cable 156 may be communicatively coupled by directly terminating the electrical wires to the internal circuit board 158, such as by soldering the electrical wires to the internal circuit board. Alternatively, the cable 156 may be communicatively coupled by other processes, such as by using connectors at the end of the cable 156 and on the internal circuit board 158. The internal circuit board 158 is supported by the pluggable body 150.

In an exemplary embodiment, the pluggable body 150 is manufactured from a conductive material, such as a metal material. The pluggable body 150 provides EMI shielding for the circuit board 158. Optionally, the pluggable body 150 may provide heat transfer for the internal circuit board 158, such as for the electronic components on the internal circuit board 158. For example, the internal circuit board 158 is in thermal communication with the pluggable body 150 and the pluggable body 150 transfers heat from the internal circuit board 158. In an exemplary embodiment, the heat is transferred from at or near the mating end 152, such as where various electrical components are located on the internal circuit board 158, to the cable end 154. In the illustrated embodiment, the mating end 152 is flat. The heat is pulled out of the receptacle assembly 104 and mating end 152 and rejected to the external environment forward of the faceplate. In other embodiments, the heat may be drawn into other portions of the pluggable body 150 and/or the heat may be directed to other portions of the pluggable body 150, such as to the mating end 152 where the heat may be transferred to another heat sink or heat transferring component inside the chassis.

In an exemplary embodiment, the pluggable body 150 includes a plurality of fins 160 extending therefrom. The fins 160 increase the surface area of the pluggable body 150 and allow greater heat transfer therefrom. The fins 160 may extend from any portion of the pluggable body 150, such as the top, the sides and/or the bottom. In the illustrated embodiment, the fins 160 are parallel plates with airflow channels therebetween. The plates may extend continuously between opposite ends of the fins 160. In alternative embodiments, other types of fins 160 may be used, such as fins 160 in the form of pins or posts extending from the pluggable body 150. The pin-shaped fins 160 may be arranged in rows and columns and may be separated from each other to allow airflow around the pins and between the various pins.

Figure 3:
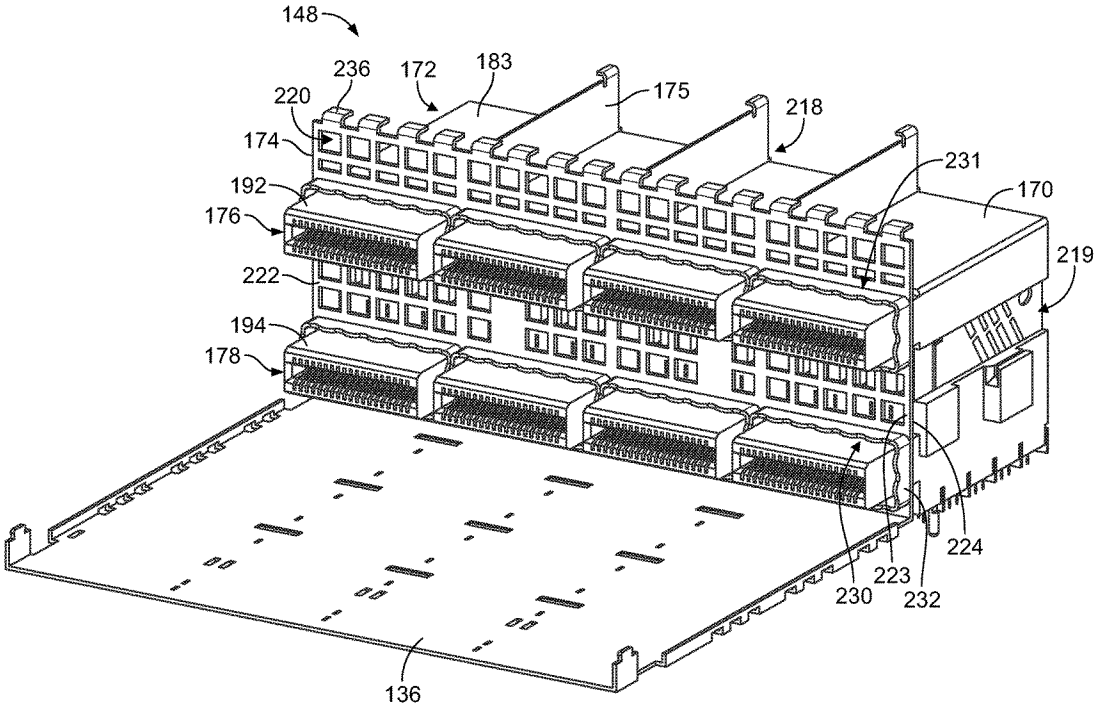
FIG. 3 is a front perspective view of a connector module assembly of the receptacle assembly in accordance with an exemplary embodiment.

FIG. 3 is a front perspective view of the connector module assembly 148 in accordance with an exemplary embodiment. The connector module assembly 148 includes a plurality of communication connectors 170 ganged together to form a communication module 172. The communication connectors 170 are configured to interface with the pluggable modules 106 (shown in FIG. 2) when the pluggable modules 106 are coupled to the connector module assembly 148.

The connector module assembly 148 includes a gasket plate 174 coupled to the communication module 172. The gasket plate 174 provides EMI shielding for the connector module assembly 148. The gasket plate 174 is configured to interface with the pluggable modules 106 when the pluggable modules 106 are coupled to the connector module assembly 148. In the illustrated embodiment, the connector module assembly 148 includes the base panel 136. Optionally, the base panel 136 may be integral with the gasket plate 174. Alternatively, the base panel 136 may be coupled to the gasket plate 174. In other various embodiments, the base panel 136 may be separate from the connector module assembly 148.

The connector module assembly 148 includes rear separator panels 175 between the communication connectors 170. The rear separator panels 175 provide electrical shielding between the adjacent communication connectors 170. In an exemplary embodiment, the rear separator panels 175 are used to hold the communication connectors 170 together to form the communication module 172. For example, each rear separator panel 175 engages both adjacent communication connectors 170. In an exemplary embodiment, the rear separator panels 175 are mechanically and electrically connected to the gasket plate 174. The rear separator panels 175 are configured to be mechanically and electrically connected to the receptacle housing 108.

Figure 5:
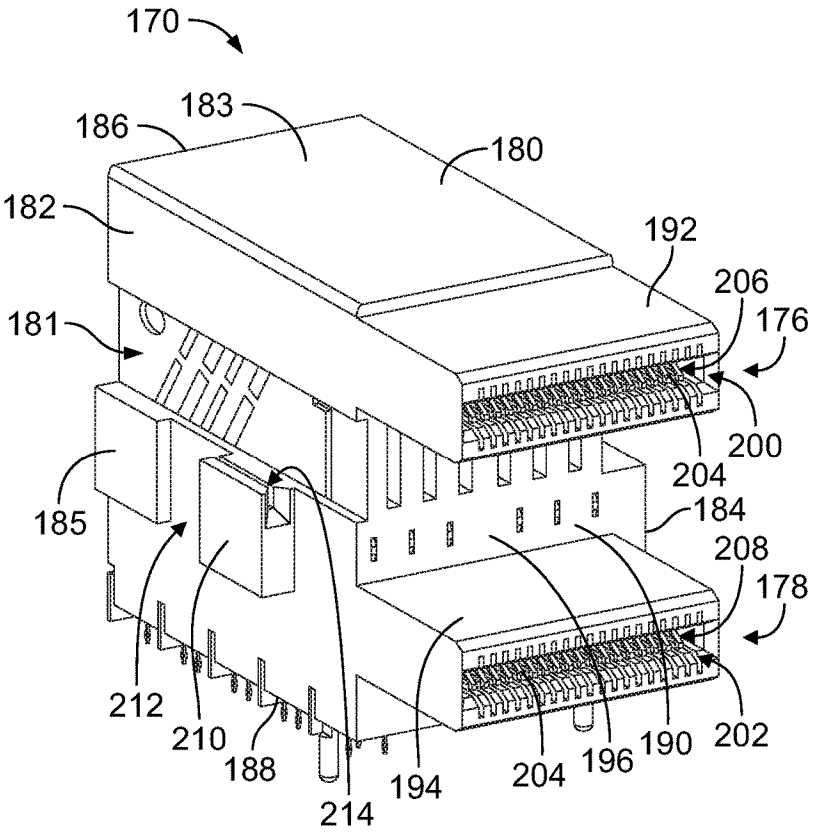
FIG. 5 is a front perspective view of the communication connectors.
Figure 4:
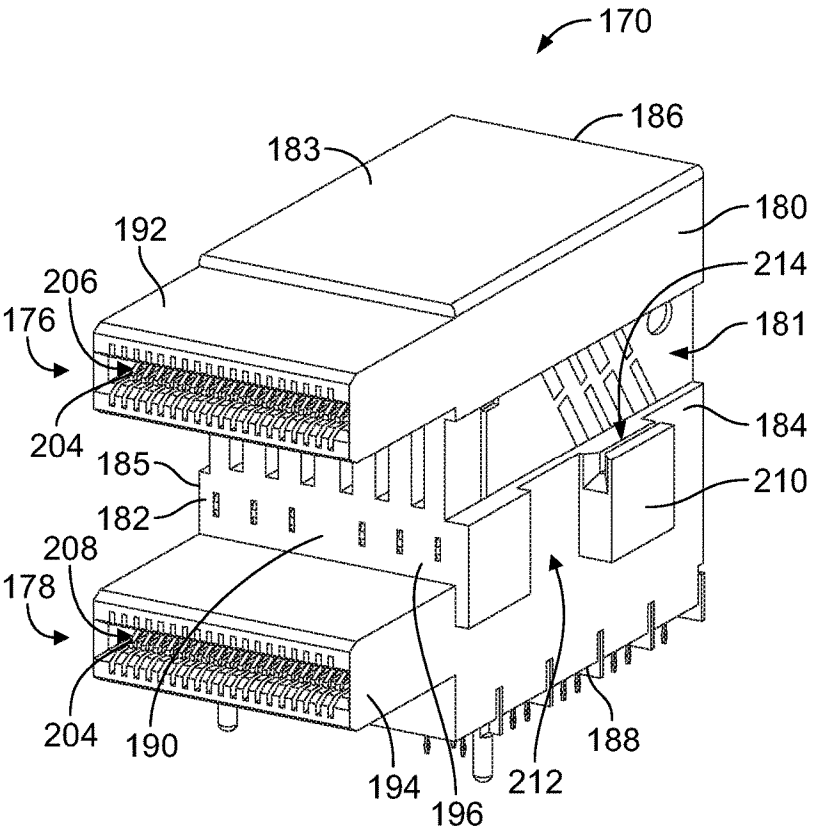
FIG. 4 is a front perspective view of a communication connector of the connector module assembly.

FIG. 4 is a front perspective view of one of the communication connectors 170 from a first side thereof. FIG. 5 is a front perspective view of one of the communication connectors 170 from a second side thereof. Optionally, each communication connector 170 within the communication module 172 (shown in FIG. 3) may be identical; however, the various communication connectors 170 may have different features in alternative embodiments (such as the outermost communication connectors 170 may have different features from the interior communication connectors 170 such as for interfacing with the receptacle housing 108 (shown in FIG. 1) and/or the rear separator panels 175 (shown in FIG. 3)).

In an exemplary embodiment, the communication connector 170 has first and second mating interfaces 176, 178 for interfacing with different pluggable modules 106; however the communication connector 170 may include a single mating interface or more than two mating interfaces in alternative embodiments. The first mating interface 176 is configured to be disposed within the upper module cavity 120 (shown in FIG. 1), and the second mating interface 178 is configured to be disposed within the lower module cavity 122 (shown in FIG. 1). Thus, in the illustrated embodiment, a single communication connector 170 may mate with two pluggable modules 106.

The communication connector 170 includes a housing 180 configured to hold one or more contact modules 181. The housing 180 is defined by an upstanding body portion 182 having a top 183, first and second sides 184, 185, a rear 186, a mounting face 188 configured to be mounted to the circuit board 102 (shown in FIG. 1), and a mating face 190 opposite the rear 186 (in the illustrated embodiment, the mounting face 188 defines a bottom 188 of the communication connector 170 and the mating face 190 defines a front 190 of the communication connector 170). Upper and lower shrouds 192 and 194 extend from the body portion 182 to define a stepped mating face 190. For example, the shrouds 192, 194 and a recessed face 196 between the shrouds 192, 194 may define the mating face 190 of the body portion 182. The shrouds 192, 194 may be generally box-shaped extensions. The shrouds 192, 194 may have other surfaces to have other shapes in alternative embodiments. For a single port cage member, the communication connector 170 may only include a single extension portion. The body portion 182 and shrouds 192, 194 may be co-molded from a dielectric material, such as a plastic material, to form the housing 180.

Receiving slots 200 and 202 extend inwardly from the mating face 190 of each of the respective upper and lower shrouds 192, 194, and extend inwardly to the body portion 182. The receiving slots 200, 202 are configured to receive card edges of the circuit boards 158 (shown in FIG. 2) of the corresponding pluggable modules 106. A plurality of contacts 204 are held by the housing 180 and are exposed within the receiving slots 200, 202 for mating with the corresponding pluggable module 106. The contacts 204 and receiving slots 200, 202 define portions of the first and second mating interfaces 176, 178. Optionally, the contacts 204 may be parts of the contact modules 181 stacked together and loaded into the housing 180 through the rear 186. Alternatively, the contacts 204 may be individual contacts stitched into the housing 180 or otherwise loaded into the housing 180. The contacts 204 are arranged to define an upper contact array 206 and a lower contact array 208. The contact arrays 206, 208 may include any number of the contacts 204. The contacts 204 may be signal contacts, ground contacts or other types of contacts and the arrays 206, 208 may have the contacts 204 in any arrangement, such as a ground-signal-signal-ground arrangement with a pair of signal contacts flanked by ground contacts.

The contacts 204 extend from the mounting face 188 for termination to the circuit board 102. For example, ends of the contacts 204 may constitute pins that are loaded into plated vias of the circuit board 102. Alternatively, the contacts 204 may be terminated to the circuit board 102 in another manner, such as by surface mounting to the circuit board 102.

The upper and lower shrouds 192, 194, receiving slots 200, 202 and contacts 204 may define identical mating interfaces 176, 178 such that the mating interfaces 176, 178 are configured to mate with any pluggable module (for example, any pluggable module 106 may be plugged into the upper module cavity 120 or the lower module cavity 122 for connection to the communication connector 170). In the illustrated embodiment, each communication connector 170 has the upper contact array 206 arranged within the upper shroud 192 at the mating interface 176 configured for mating with a corresponding pluggable module 106, and each communication connector 170 has the lower contact array 208 arranged within the lower shroud 194 at the mating interface 178 configured for mating with a corresponding pluggable module 106. The upper and lower mating interfaces 176, 178 are in a stacked arrangement.

In an exemplary embodiment, the housing 180 includes alignment features 210 extending from the sides 184, 185. In the illustrated embodiment, the alignment features 210 are lugs extending outward from the sides 184, 185 and may be referred to hereinafter as lugs 210. The lugs 210 may interact with other lugs and/or other components of the adjacent communication connector 170 to align the adjacent communication connectors 170 within the communication module 172. For example, the housings 180 may be stacked side-by-side with the corresponding lugs 210 aligned and configured to be secured together to gang the communication connectors 170 together as the communication module 172. In the illustrated embodiment, the lug 210 on the first side 184 is positioned closer to the rear 186 while the lug 210 on the second side 185 is positioned closer to the front 190. Having the lugs 210 staggered or offset on the opposite sides 184, 185 allows aligning of the lugs 210 with lugs 210 of adjacent communication connectors 170. In an exemplary embodiment, the housing 180 includes pockets 212 adjacent the lugs 210. The pockets 212 receive lugs of adjacent communication connectors 170. In the illustrated embodiment, the pocket 212 on the first side 184 is positioned forward of the lug 210 on the first side 184 while the pocket 212 on the second side 185 is positioned rearward of the lug 210 on the second side 185. In an exemplary embodiment, the lugs 210 includes slots 214 formed in the tops of the lugs 210. The slots 214 are configured to receive the rear separator panels 175.

Figure 6:
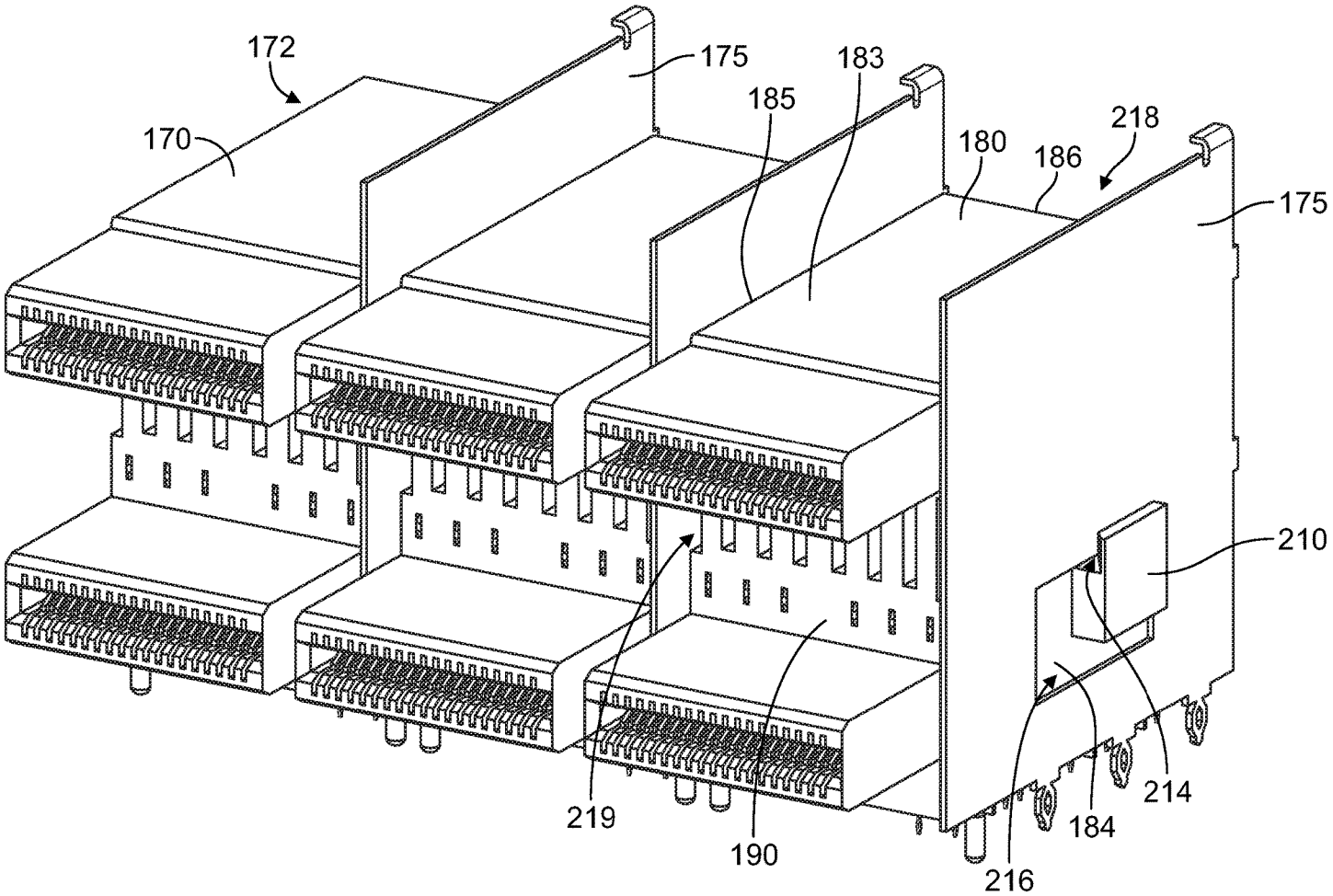
FIG. 6 is a partially assembled view of a communication module of the connector module assembly.
Figure 7:
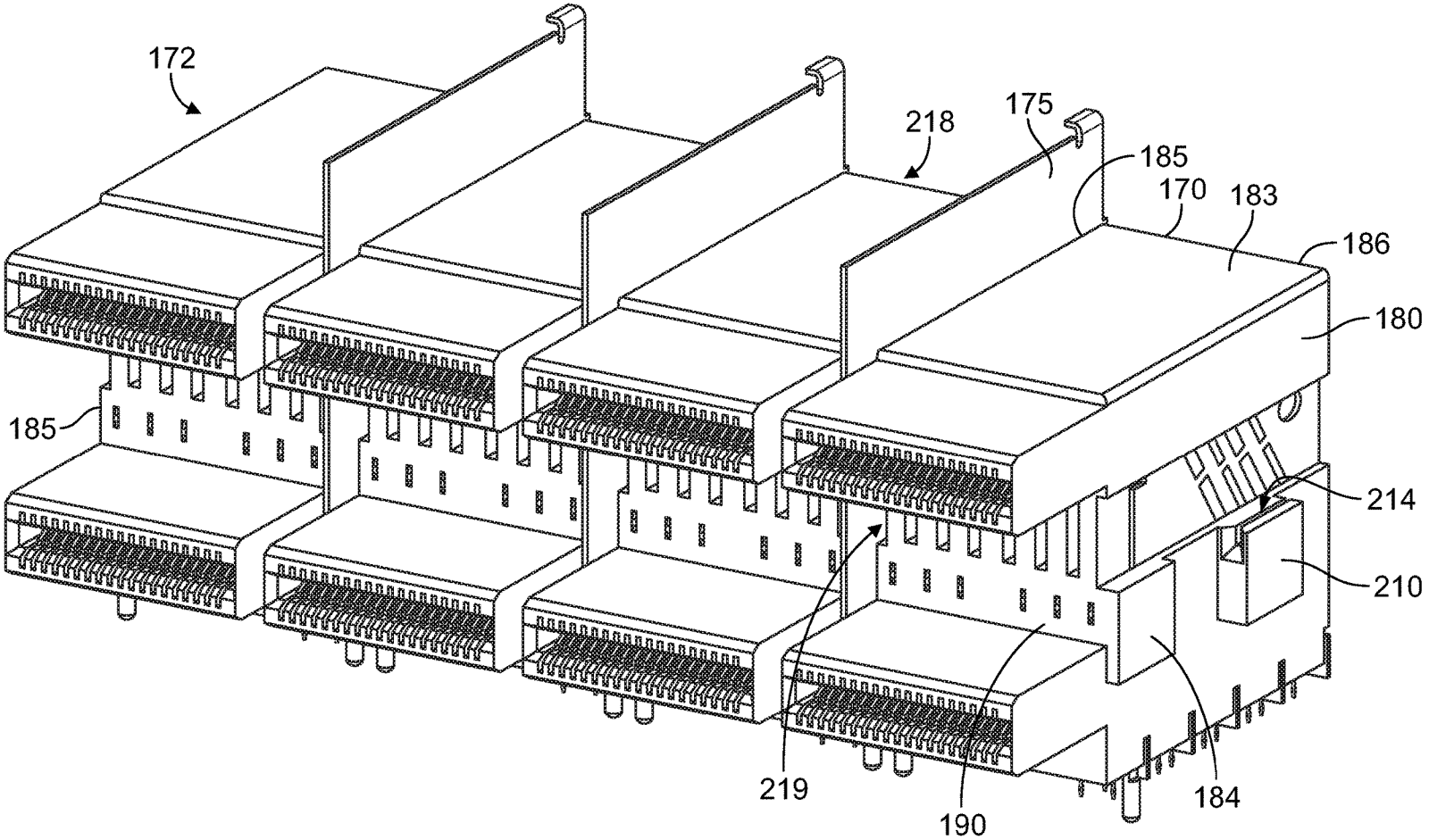
FIG. 7 is a fully assembled view of the communication module.

FIG. 6 is a partially assembled view of the communication module 172. FIG. 7 is a fully assembled view of the communication module 172. During assembly, the rear separator panels 175 are coupled to the communication connectors 170. The rear separator panels 175 are positioned between adjacent communication connectors 170. The rear separator panels 175 include openings 216 (FIG. 6) that receive the corresponding lugs 210. For example, each opening 216 may receive one lug 210 from one of the communication connectors 170 and another lug 210 from the adjacent communication connector 170. In an exemplary embodiment, the lugs 210 are received in the opening 216 such that the slots 214 are aligned to receive the planar rear separator panel 175. In other various embodiments, the rear separator panels 175 may have multiple openings 216 that receive corresponding lugs 210.

When the housings 180 are stacked adjacent each other, the lugs 210 are staggered front to back to receive the corresponding separator panels 175. The housings 180 may be stacked side-by-side with the corresponding lugs 210 aligned and configured to be secured together by the separator panels 175 to gang the communication connectors 170 together as the communication module 172. Having the lug 210 on the first side 184 positioned toward the rear 186 and the lug 210 on the second side 185 positioned toward the front 190 allows aligning of the lugs 210 (with one lug positioned forward of the other lug 210) for tighter positioning of the communication connectors 170.

In an exemplary embodiment, the rear separator panels 175 extend above the tops 183 of the communication connectors 170. Airflow channels 218 may be defined above the tops 183 of the communication connectors 170 between the rear separator panels 175. Optionally, the lugs 210 may be coupled to the rear separator panels 175 such that side airflow channels 219 are defined along the sides 184, 185 of the communication connectors 170. The lugs 210 may hold the communication connectors 170 spaced apart from the rear separator panels 175, at least along portions thereof, to define the side airflow channels 219 between the rear separator panels 175 and the corresponding first and second sides 184, 185 of the adjacent communication connectors 170. The side airflow channels 219 may be defined, at least in part, by grooves formed in the sides 184, 185.

Returning to FIG. 3, the connector module assembly 148 is shown with the communication module 172 in an assembled state and with the gasket plate 174 coupled to the front of the communication module 172. The separator panels 175 may be mechanically and electrically connected to the gasket plate 174. The separator panels 175 are electrically connected to the gasket plate 174, such as by a direct, physical engagement therewith.

The gasket plate 174 is formed from a conductive material, such as sheet metal. In the illustrated embodiment, the gasket plate 174 is stamped and formed from sheet metal. In some embodiments, the gasket plate 174 is configured to facilitate airflow therethrough, such as through airflow openings 220 sized small enough such that the gasket plate 174 provides effective EMI shielding. The airflow openings 220 may be aligned with the airflow channels 218 and/or with the side airflow channels 219 in the communication module 172 to allow airflow therethrough. Optionally, the airflow openings 220 may allow airflow vertically through the receptacle assembly 104, such as from the pluggable module 106 and shroud 194 associated with the lower module cavity 122 to the pluggable module 106 and shroud 192 associated with the upper module cavity 120.

The gasket plate 174 includes one or more sheets 222 configured to provide EMI shielding for the mating interface between the pluggable modules 106 and the communication module 172. In the illustrated embodiment, the sheets 222 are oriented vertically to provide a planar gasket plate 174. The gasket plate 174 includes an exterior or front side 223 and an interior or rear side 224. The front side 223 faces the pluggable modules 106. The rear side 224 faces the communication module 172. Other configurations are possible, such as a Z-plate having one or more horizontal sheets and/or one or more angled sheets and/or one or more vertical sheets. In an exemplary embodiment, the sheets 222 of the gasket plate 174 provide EMI shielding for all of the pluggable modules 106 and corresponding mating interfaces 176, 178 of the communication connectors 170. The gasket plate 174 is configured to directly contact the panels or sheets of the housing 108 (shown in FIG. 1) to electrically common the gasket plate 174 and the housing 108.

In an exemplary embodiment, the gasket plate 174 includes upper and lower openings 230 therethrough that receive corresponding shrouds 192, 194. The gasket plate 174 has pluggable module interfaces 231 around each of the openings 230 for interfacing with mating ends 152 (shown in FIG. 2) of the pluggable modules 106 associated with the corresponding openings 230. Optionally, the gasket plate 174 has gaskets 232 at the pluggable module interfaces 231 at the front side 223 around the openings 230. The gaskets 232 are configured to interface with mating ends 152 (shown in FIG. 2) of the pluggable modules 106. For example, the gaskets 232 may extend entirely around the openings 230 to mate with the flat mating ends 152 of the pluggable modules 106. The gaskets 232 may be compressible. The gaskets 232 are conductive and provide an interface between the pluggable modules 106 and the gasket plate 174.

In an exemplary embodiment, the gasket plate 174 extends above the tops 183 of the communication connectors 170, such as to engage the top wall 140 (shown in FIG. 1) of the receptacle housing 108. The airflow openings 220 allow airflow to the airflow channels 218 along the tops 183. The gasket plate 174 may include grounding portions 236 at the top end configured to mechanically and electrically couple to the top wall 140 of the receptacle housing 108. The grounding portions 236 may be deflectable spring beams. The grounding portions 236 may be tabs configured to be folded over to lock to the corresponding panel of the receptacle housing 108. The grounding portions 236 may be mechanically and electrically connected to the panel by other means or processes in alternative embodiments. In other various embodiments, the gasket plate 174 may include a top wall that extends along the tops 183 to the back wall 146 (shown in FIG. 1) rather than extending to the top wall 140.

Figure 8:
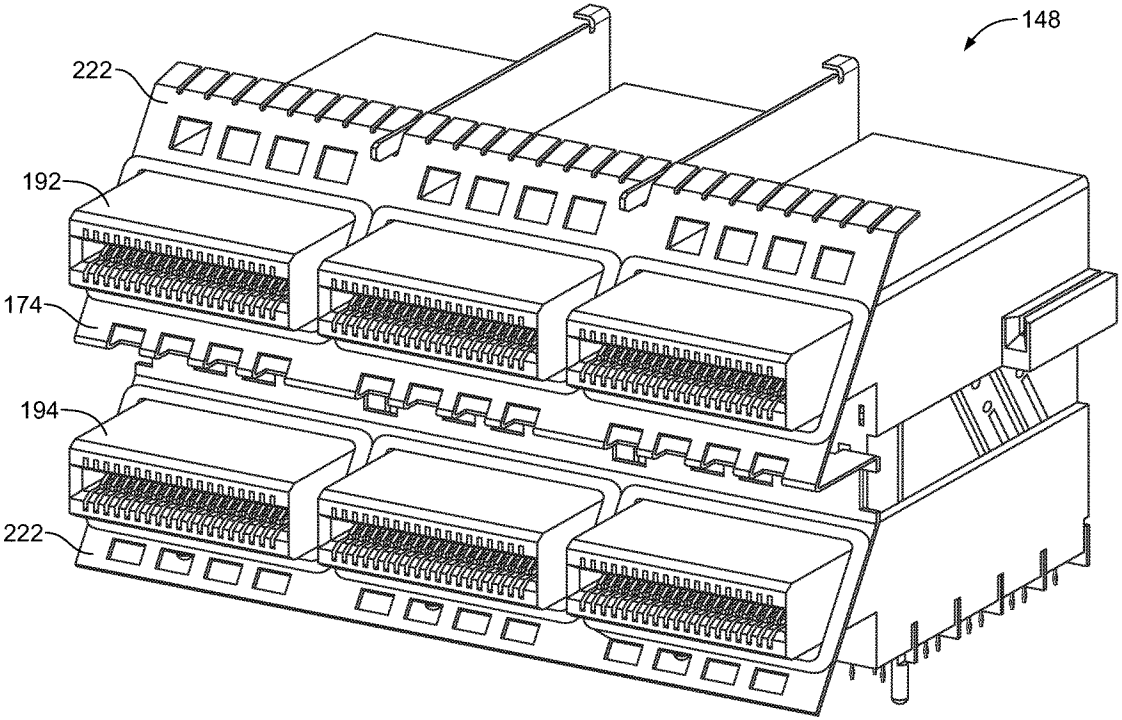
FIG. 8 is a front perspective view of the connector module assembly in accordance with an exemplary embodiment.

FIG. 8 is a front perspective view of the connector module assembly 148 in accordance with an exemplary embodiment. The connector module assembly 148 illustrated in FIG. 8 is similar to the embodiment illustrated in FIG. 7; however, the gasket plate 174 includes angled sheets 222, such as for interfacing with pluggable modules 106 having angled mating ends. The shrouds 192, 194 pass through the angled sheets 222.

Figure 9:
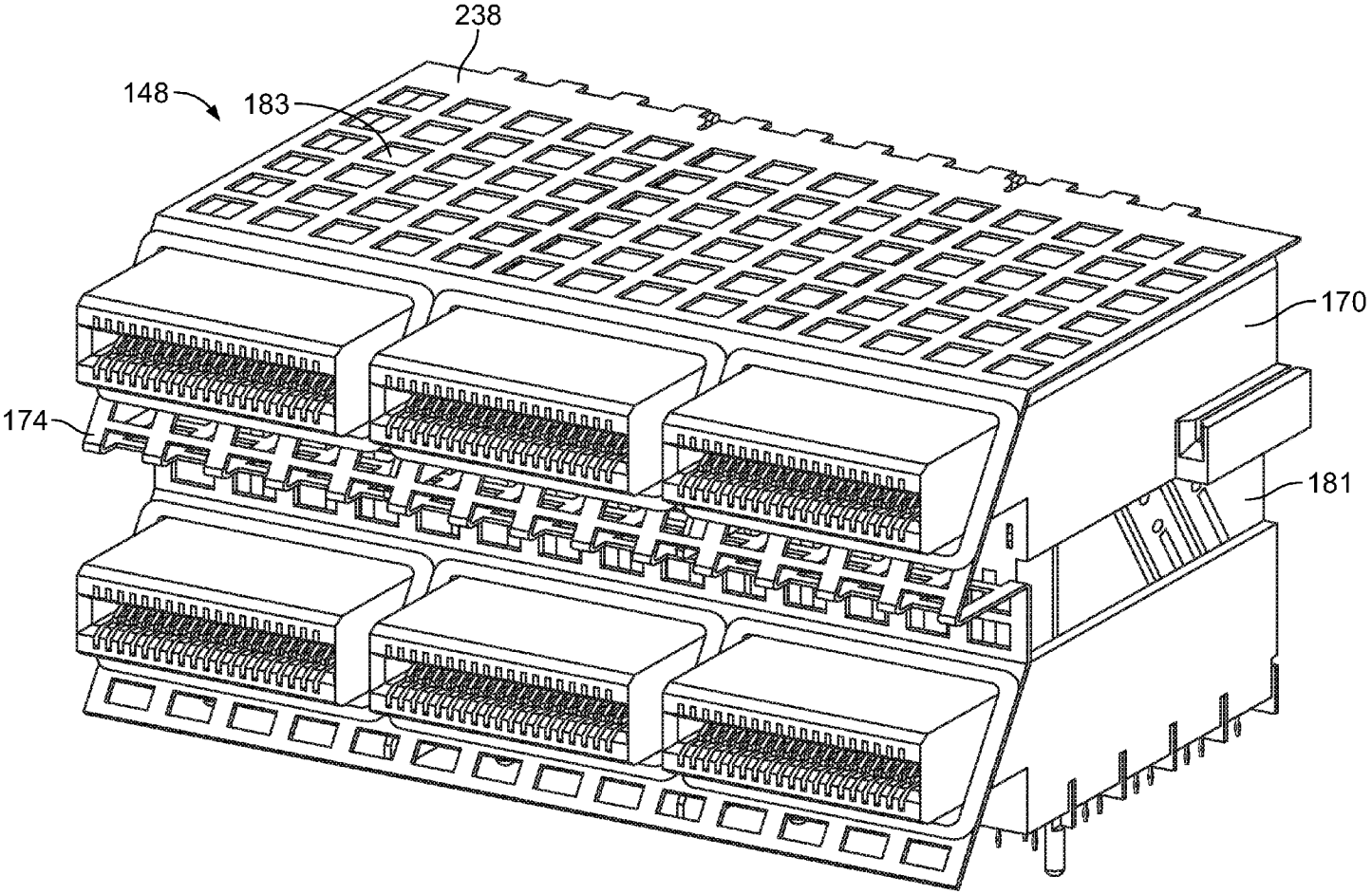
FIG. 9 is a front perspective view of the connector module assembly in accordance with an exemplary embodiment.

FIG. 9 is a front perspective view of the connector module assembly 148 in accordance with an exemplary embodiment. The connector module assembly 148 illustrated in FIG. 9 is similar to the embodiment illustrated in FIG. 7; however, the gasket plate 174 includes a top sheet 238 that extends along the tops 183 of the communication connectors 170.

Figure 10:
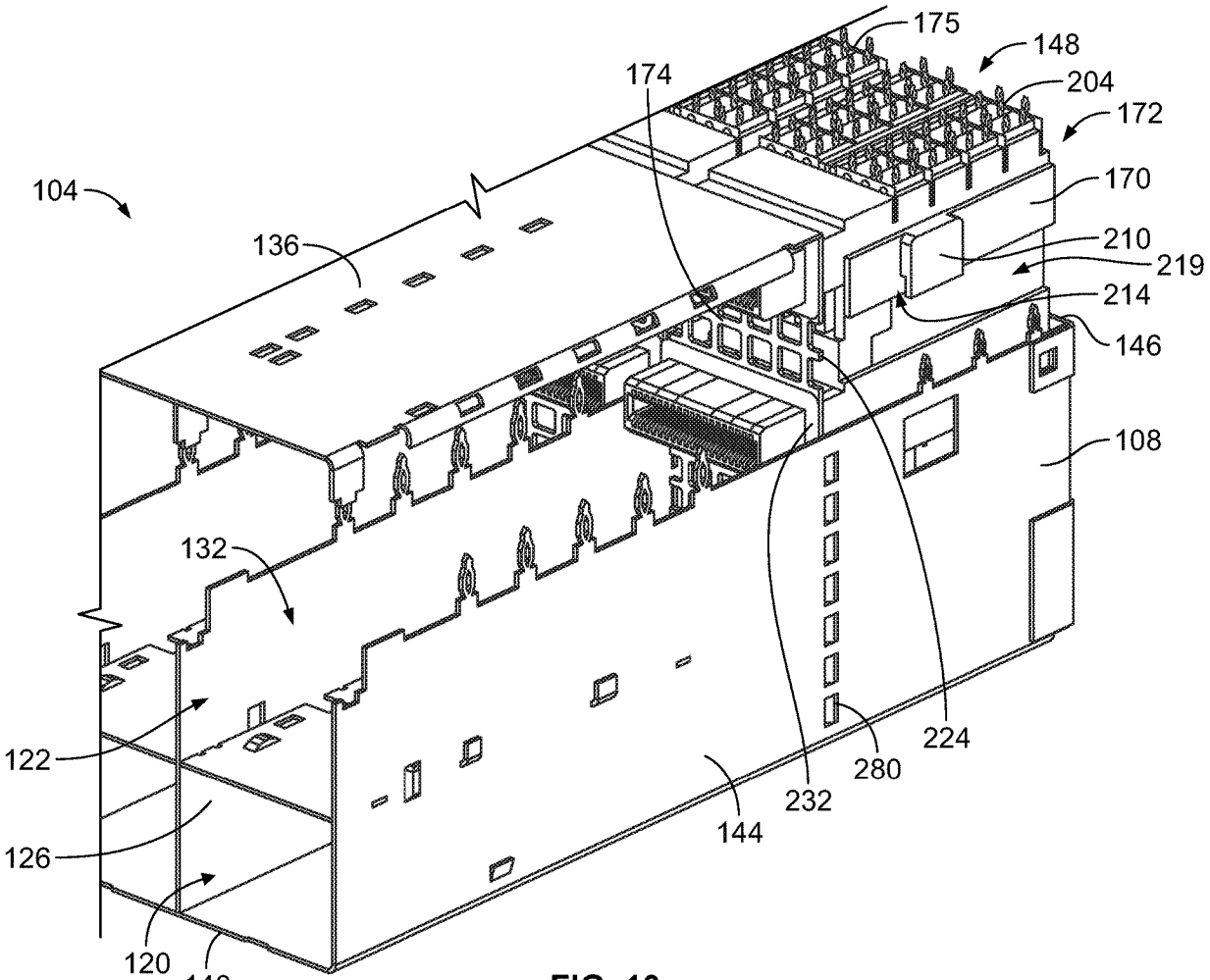
FIG. 10 is a sectional view of a portion of the receptacle assembly in accordance with an exemplary embodiment.
Figure 11:
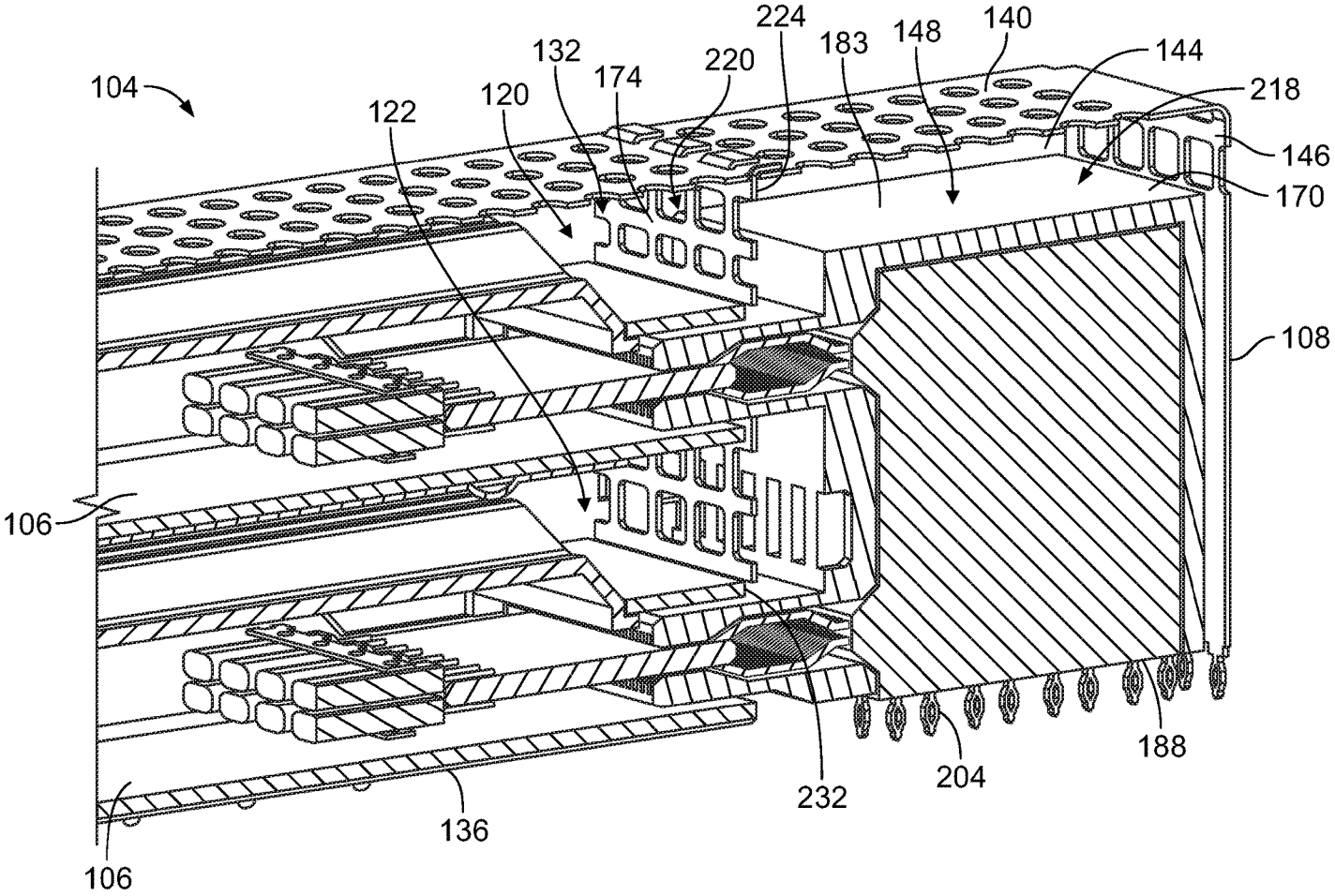
FIG. 11 is a sectional view of a portion of the receptacle assembly in accordance with an exemplary embodiment.

FIG. 10 is a sectional view of a portion of the receptacle assembly 104 in accordance with an exemplary embodiment. FIG. 11 is a sectional view of a portion of the receptacle assembly 104 in accordance with an exemplary embodiment. FIG. 10 shows the connector module assembly 148 partially loaded into the receptacle housing 108. FIG. 11 shows the connector module assembly 148 fully loaded into the receptacle housing 108.

In an exemplary embodiment, the connector module assembly 148 is configured to be bottom loaded into the housing cavity 132 through the bottom 188 of the receptacle housing 108. The receptacle housing 108 is open at the bottom 188 to receive the connector module assembly 148 through the bottom 188. As the connector module assembly 148 is loaded into the receptacle housing 108, the connector module assembly 148 may be coupled to the receptacle housing 108. For example, the lugs 210 (shown in FIGS. 4-5) may be secured to corresponding side walls 142, 144, such as received in corresponding openings 216, with the side walls 142, 144 received in the slots 214 (shown in FIGS. 4-5) of the lugs 210. The gasket plate 174 may be coupled to the side walls 142, 144 and the top wall 140 or the back wall 146. The rear separator panels 175 (FIG. 10) are coupled to the top wall 140 and/or the back wall 146. The base panel 136, which may be part of the connector module assembly 148, may be coupled to the side walls 142, 144. In other various embodiments, the connector module assembly 148 may be loaded in through the back wall 146 of the receptacle housing 108.

When assembled, the gasket plate 174 separates the communication module 172 from the module cavities 120, 122. The gasket plate 174 separates the front separator panels 126 from the rear separator panels 175. However, the front separator panels 126 are aligned with the rear separator panels 175 on opposite sides of the gasket plate 174. The gasket plate 174 is positioned forward of the airflow channels 218 and the airflow openings 220 allow airflow between the airflow channels 218 and the module cavities 120, 122. The gasket plate 174 is positioned forward of the side airflow channels 219 and the airflow openings 220 allow airflow between the side airflow channels 219 and the module cavities 120, 122.

In an exemplary embodiment, the receptacle housing 108 includes grounding portions 280 extending into the housing cavity 132 from the side walls 142, 144. The grounding portions 280 may be stamped from the side walls 142, 144 and bent inward into the housing cavity 132 leaving openings along the side walls 142, 144. The openings left behind from stamping and forming the grounding portions 280 may be sufficiently small to prevent EMI leakage through the side walls 142, 144. The grounding portions 280 are configured to interface with the gasket plate 174 for electrical connection between the receptacle housing 108 and the gasket plate 174. In an exemplary embodiment, the grounding portions 280 are deflectable and flexible to allow mating with the gasket plate 174. Optionally, the grounding portions 280 may be spring beams that are elastically deformed against the gasket plate 174 to ensure that the grounding portions 280 maintain contact with the gasket plate 174.

The grounding portions 280 are positioned rearward of the rear side 224 of the gasket plate 174. In an exemplary embodiment, the gasket plate 174 is movable relative to the receptacle housing 108. For example, the gasket plate 174 may float within the housing cavity 132 from a forward position to a rearward position to allow mating with the pluggable module 106. As the pluggable module 106 is loaded into the receptacle housing 108, the pluggable module 106 may seat against the gasket 232 and further loading of the pluggable module 106 causes the gasket plate 174 to float rearward. In an exemplary embodiment, the grounding portions 280 are deflectable to accommodate the floating movement of the gasket plate 174, such as in the mating direction, to the rearward position. As the gasket plate 174 moves rearward, the grounding portions 280 are deflected rearward in engagement with the gasket plate 174. As such, a reliable electrical connection is made between the receptacle housing 108 and the gasket plate 174. The grounding portions 280 may define a positive stop for the gasket plate 174 as the gasket plate 174 is pressed rearward by the pluggable module 106.

In an exemplary embodiment, the connector module assembly 148 is loaded into the receptacle housing 108 prior to mounting the receptacle assembly 104 to the circuit board 102 (shown in FIG. 1). As such, the connector module assembly 148 may be mounted to the circuit board 102 with the receptacle housing 108 as a unit. The receptacle assembly 104 is press-fit to the circuit board 102, such as by pressing the grounding pins of the receptacle housing 108 and the contacts 204 into plated vias in the circuit board 102. The ends of the contacts 204, which may be eye-of-the-needle pins, are pressed into the circuit board 102 together with the receptacle housing 108. For example, as the receptacle housing 108 is pressed downward onto the circuit board in a pressing direction, the pressing forces imparted on the receptacle housing 108 are transferred to the communication connectors 170, such as through the lugs 210. The side walls 142, 144 are coupled to corresponding lugs 210 and the rear separator panels 175 are coupled to corresponding lugs 210, and the pressing forces are transferred to the rear separator panels 175 through the direct coupling of the rear separator panels 175 to the top wall 140. As such, as the receptacle housing 108 is pressed downward, the communication connectors 170 are likewise pressed downward even though the top 183 of the communication connector 170 does not directly engage the top wall 140, allowing space for the airflow channel 218 between the top 183 and the top wall 140 to enhance cooling airflow through the receptacle assembly 104.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A receptacle assembly comprising:

a plurality of communication connectors arranged side-by-side and secured together as a communication module, each communication connector having a contact array arranged within a shroud at a mating interface, the shroud and contact array being configured for mating with a corresponding pluggable module, each communication connector having a mounting face at a bottom of the corresponding communication connector, the contact array being provided at the mounting face for mounting to a circuit board; and a gasket plate coupled to the communication module between the communication module and the pluggable modules, the gasket plate having a plurality of openings receiving corresponding shrouds such that the shrouds pass through the openings for mating with the corresponding pluggable modules, the gasket plate having pluggable module interfaces around each of the openings for interfacing with mating ends of the pluggable modules associated with the corresponding openings, the gasket plate being conductive to provide electromagnetic interference (EMI) shielding at the pluggable module interfaces, the gasket plate engaging the pluggable modules at the pluggable module interfaces to electrically connect the gasket plate with conductive pluggable bodies of the pluggable module; and a receptacle housing having a plurality of panels defining a housing cavity, the plurality of panels dividing the housing cavity into a plurality of module cavities each configured to receive a corresponding pluggable module therein, the panels being conductive to provide electromagnetic interference (EMI) shielding for the housing cavity, the receptacle housing configured to be mounted to the circuit board at a bottom of the receptacle housing;

wherein the gasket plate is coupled to the communication module to define a connector module assembly, the connector module assembly being loaded into the housing cavity prior to mounting to the circuit board such that the connector module assembly and the receptacle housing are configured to be mounted to the circuit board as a unit.

2. The receptacle assembly of claim 1, wherein the gasket plate is mechanically and electrically connected to the receptacle housing.

3. The receptacle assembly of claim 1, wherein the gasket plate separates the communication module from the module cavities.

4. The receptacle assembly of claim 1, wherein the panels of the receptacle housing define a top wall, side walls and a back wall defining the housing cavity, and wherein the panels of the receptacle housing include front separator panels dividing the housing cavity into the module cavities, the receptacle housing being open at the bottom to receive the connector module assembly through the bottom.

5. The receptacle assembly of claim 4, wherein the connector module assembly includes a base panel extending forward of the gasket plate, the base panel closing the bottom of the receptacle housing below the module cavities.

6. The receptacle assembly of claim 1, wherein the connector module assembly includes rear separator panels between each of the communication connectors providing electrical shielding therebetween.

7. The receptacle assembly of claim 6, wherein the panels of the receptacle housing include front separator panels dividing the housing cavity into the module cavities, the gasket plate separating the front separator panels from the rear separator panels.

8. The receptacle assembly of claim 6, wherein the gasket plate is mechanically and electrically connected to the rear separator panels.

9. The receptacle assembly of claim 6, wherein adjacent communication connectors are mechanically secured to the corresponding rear separator panels to fix relative positions of the communication connectors within the communication module.

10. The receptacle assembly of claim 6, wherein each communication connector includes a housing having a first side and a second side, the first side having a first lug, the second side having a second lug, the rear separator panels engaging corresponding first and second lugs of the adjacent communication connectors to secure the communication connectors together as the communication module.

11. The receptacle assembly of claim 10, wherein the first and second lugs hold the communication connectors spaced apart from the rear separator panels to define side airflow channels between the rear separator panels and the corresponding first and second sides of the adjacent communication connectors, the gasket plate being positioned forward of the side airflow channels, the gasket plate including airflow openings therethrough to allow airflow between the side airflow channels and the module cavities.

12. The receptacle assembly of claim 10, wherein the first lugs are offset with respect to the second lugs relative to the front of the communication connectors such that first and second lugs of different communication connectors are configured to be aligned to receive the rear separator panels with the first lug positioned rearward of the second lug of the corresponding communication connectors.

13. The receptacle assembly of claim 10, wherein the first and second lugs include slots, the slots of the first and second lugs of the adjacent communication connectors being aligned to receive corresponding rear separator panels to fix the positions of the communication connectors relative to the rear separator panels.

14. The receptacle assembly of claim 6, wherein the rear separator panels are mechanically coupled to at least one of the panels of the receptacle housing and the rear separator panels are mechanically coupled to the adjacent communication connectors, the rear separator panels transferring pressing forces from the receptacle housing to the communication connectors to press fit mount the contact array to the circuit board.

15. The receptacle assembly of claim 6, wherein the communication connectors include tops, the rear separator panels extending above the top of the communication connectors a distance to a top wall of the receptacle housing such that airflow channels are defined between the tops of the communication connectors and the top wall, the gasket plate being positioned forward of the airflow channels and extending to the top wall, the gasket plate including airflow openings therethrough to allow airflow between the airflow channels and the module cavities.

16. The receptacle assembly of claim 1, wherein the gasket plate is floatable relative to the communication module for mating with the pluggable modules.

17. The receptacle assembly of claim 1, wherein each communication connector includes plural contact arrays and plural shrouds in a stacked arrangement defining an upper contact array in an upper shroud and a lower contact array and a lower shroud, the gasket plate having upper openings receiving corresponding upper shrouds and lower openings receiving corresponding lower shrouds.

18. A receptacle assembly comprising:

a receptacle housing having a plurality of panels defining a housing cavity, the receptacle housing having a bottom for mounting to a circuit board, the plurality of panels including front separator panels dividing the housing cavity into a plurality of module cavities each configured to receive a corresponding pluggable module therein, the module cavities being arranged in a plurality of rows and a plurality of columns, the panels being conductive to provide electromagnetic interference (EMI) shielding for the housing cavity; and a connector module assembly received in the housing cavity, the connector module assembly comprising:

a plurality of communication connectors arranged side-by-side as a communication module, each communication connector having a contact array arranged within a shroud at a mating interface, the shroud and contact array being aligned with a corresponding module cavity and configured for mating with a corresponding pluggable module, the contact array being configured to be mounted to a circuit board;

a plurality of rear separator panels arranged between adjacent communication connectors, the communication connectors being secured to the corresponding adjacent rear separator panels to secure the communication connectors together as the communication module; and a gasket plate coupled to the communication module and positioned between the front separator panels and the rear separator panels, the gasket plate spanning across and between each of the module cavities, the gasket plate spanning across and between each of the communication modules, the gasket plate having a plurality of openings aligned with corresponding module cavities and receiving corresponding shrouds such that the shrouds pass through the openings into the corresponding module cavities for mating with the pluggable modules, the gasket plate having pluggable module interfaces around each of the openings for interfacing with mating ends of the pluggable modules associated with the corresponding openings to electrically connect the gasket plate to conductive pluggable bodies of the pluggable modules, the gasket plate being conductive to provide EMI shielding at the pluggable module interfaces.

19. The receptacle assembly of claim 18, wherein the connector module assembly is loaded into the housing cavity prior to mounting to the circuit board such that the connector module assembly and the receptacle housing are configured to be mounted to the circuit board as a unit.

20. A connector module assembly comprising:

a plurality of communication connectors arranged side-by-side as a communication module, each communication connector having a housing holding a contact array, the housing includes a shroud including a receiving slot with the contact array disposed in the receiving slot for mating with a corresponding pluggable module, the housing having a first side with a first lug and a second side with a second lug;

a plurality of rear separator panels arranged between adjacent communication connectors, the rear separator panels engaging corresponding first and second lugs of the adjacent communication connectors to secure the communication connectors together as the communication module; and a gasket plate coupled to the communication module, the gasket plate having a plurality of openings receiving corresponding shrouds such that the shrouds pass through the openings for mating with the pluggable modules, the gasket plate having pluggable module interfaces around each of the openings for interfacing with mating ends of the pluggable modules associated with the corresponding openings, the gasket plate being conductive to provide EMI shielding at the pluggable module interfaces.

* * * * *